US005477980A

United States Patent [19]

Chaffin

[11] Patent Number: 5,477,980

[45] Date of Patent: Dec. 26, 1995

[54] RECEPTACLE COVER WITH VALVE CONTROLLED OPENINGS

[76] Inventor: Jeffrey D. Chaffin, 3255 S. Parker Rd., Bldg. #2, Apt. #302, Aurora, Colo. 80014

[21] Appl. No.: 354,162

[22] Filed: Dec. 8, 1994

[51] Int. Cl.[6] ..... A47G 19/22; B67D 3/02

[52] U.S. Cl. ..... 220/715; 220/710.5; 220/714; 222/484; 222/517; 222/556

[58] Field of Search ..... 220/254, 264, 220/303, 714, 715, 713, 710.5, 338; 222/481.5, 484, 588, 517, 556, 560; 215/311, 315, 313

[56] References Cited

U.S. PATENT DOCUMENTS

| | | | |
|---|---|---|---|
| 523,094 | 7/1894 | Wilson | 222/517 X |
| 1,486,199 | 3/1924 | Skiles | 222/517 X |
| 2,304,457 | 12/1942 | Hagan | 222/484 X |
| 2,574,338 | 11/1951 | Lewis | 222/484 X |
| 4,099,642 | 7/1978 | Nergard | 220/90.4 |
| 4,133,446 | 1/1979 | Albert | 220/90.4 |
| 4,276,992 | 7/1981 | Susich | 220/254 |
| 4,303,173 | 12/1981 | Nergard | 220/254 |

*Primary Examiner*—Allan N. Shoap
*Assistant Examiner*—Robin A. Hylton
*Attorney, Agent, or Firm*—Henderson & Sturm

[57] ABSTRACT

A receptacle cover is disclosed incorporates an actuating trigger connected to a pair of biased valves that seal off the dispensing conduit and the relief vent from the top side of the cover. This construction isolates most of the linkage between the valves and the actuator from the contents of the receptacle. The actuator is a trigger located proximate the upper portion of a handle extending from the cover, and is linked to the valves by a wire that extends to, and moves, a rotating rod that is perpendicularly disposed in relation to the wire. The rod, in turn, is attached to the valves by additional wires that force them open against their proximate leaf springs. The dispensing conduit forms a plenum or chamber that functions in a manner similar to a straw by extending upwards from the cover. This construction prevents inadvertent leakage or fluid build up on the exterior of the receptacle. Alternatively, instead of the leaf springs, the bodies of the valve could be made of a resilient material, and the valves placed in a substantially parallel overlying relationship to the cover top, the construction serving as a bias towards the closing of the dispensing conduit and the relief vent.

9 Claims, 2 Drawing Sheets

RECEPTACLE COVER WITH VALVE CONTROLLED OPENINGS

BACKGROUND OF THE INVENTION

REFERENCE TO RELATED PUBLICATIONS

The present invention was registered in the United States Patent and Trademark Office under the Document Disclosure Program. The date received was Sep. 13, 1993 and the registration number is 339,290.

1. Field of the Invention

The present invention relates to receptacle covers. More specifically, it relates to a construction for a cover of a drinking glass or mug that allows the user to drink from the glass while in motion or otherwise occupied, while not accidentally spilling the contents thereof. Even more specifically, it relates to a cover construction for a receptacle wherein a biased lever or activator connected to valves on top of the cover is pressed to allow fluid communication between the interior of the receptacle and the exterior. This communication is at two points: the first being the drinking mouth, and the other being a vent to allow the contents of the receptacle to flow smoothly. When the lever is released, the valves seat themselves on the cover top.

More generally, the invention relates to any application where it is desired that the contents of a receptacle or container be selectively in or out of fluid communication with the exterior thereof, such as a storage tank or like object. Furthermore, the contents of the receptacle would not necessarily have to be a liquid in fact: it would be conceivable for the contents to be solid, granular in nature for instance, such as in a grain storage silo. Additionally, though the nature of the closure described herein is that of a cover, it should be understood that a side, or even bottom mounting of the closure according to the instant invention would be within the scope of the invention.

Thus it can be seen that the potential fields of use for this invention are myriad, and the particular preferred embodiment described herein is in no way meant to be limiting the particular field chosen for exposition of the details of the invention.

2. Description of the Prior Art

Covers with manually controllable valves are well known devices. These apparatus are sometimes used to keep liquids from spilling from a receptacle while the user is in motion. If one looks around on busy roads during a morning commute in an urban area, these devices are practically ubiquitous, with people drinking coffee or tea as they drive. Other uses, of course, are obvious: use during sports such as running, cycling, or competitive walking (race walking), while boating, or any endeavor wherein the user would be in motion, either under their own power or by mechanical means. Covers such as these can also be used to insulate the contents of the receptacle, limiting the heat exchange with the ambient outer environment, except when desired by the user. One of the disadvantages of these prior art devices is that many parts extend into the receptacle's interior. This leads to sticky operation (since many people put sugar into their coffee, or that many beverages contain sugar as one of their ingredients), and presents difficulty when the user attempts to clean the apparatus. One of the advantages of the present invention is that contact between elements of the valve linkage apparatus and the contents of the receptacle is kept to a minimum. Another advantage of the instant invention is the construction of the "straw-like" fluid conduit plenum or chamber. This extends upwards from the top of the cover and prevents inadvertent spillage while the valves are in the open position, and also prevents the gradual fluid buildup around the lip of the receptacle as is seen with contemporary art devices. Additionally, the apparatus as described herein can be constructed such that it is easy to clean. During a search at the U.S. Patent and Trademark Office, a number of patents were uncovered that relate to the invention described herein.

Firstly, in U.S. Pat. No. 4,099,642 issued on Jul. 11, 1978 to Orv Nergard there is disclosed a drinking receptacle cover and valve assembly. In this device, an actuating member terminating in a manually operable push button is disposed diametrically opposite the beverage outlet opening in the flat plate portion of the cover. Opposite the push button portion of the actuating member is a camming surface that engages with a cooperating camming surface located on the underside of a valve head. The valve head is dimensioned to close the beverage outlet and is biased to do so by integrally formed resilient arms. Also integral to the valve head is a resilient strip terminating in a fork that engages a collar on the actuating member proximate the interior surface of the cover. Thus, the actuating member is biased outwardly, and only on the pressing of the push button are the interengaging camming surfaces moved into relationship with one another. Compare this to the instant invention wherein the interengagement of the actuating portion and a rotating rod that transmits the trigger movement to the valves is carried out by wires or like objects that connect the trigger, rod, and valves; and that the valve members engage the top of the cover, without extending down into the interior of the receptacle as Nergard '642 shows.

In U.S. Pat. No. 4,133,446 issued on Jan. 9, 1979 to Kenneth J. Albert there is disclosed a drinking vessel cover with valve controlled openings. The cover has an inclined flat wall at its top that has therein a drinking opening and a relief vent, diametrically opposed to one another. Depending from the underside of the wall are two lugs. These lugs are formed with journal recesses that carry a lever such that a pivotal mounting is created. One end of this pivoting lever carries a stub arm that extends through the drinking opening and a valve member on the end thereof dimensioned so that the opening is closed off when the valve member engages the upper surface of the top cover wall. At the distal end of the lever is a valve member and a pushbutton portion that extends through the relief vent to project above the cover. A leaf spring biases the lever such that the valve member closes the drinking opening unless the pushbutton is pressed. Contrast this to the present invention where the entire linkage between the actuator and the valves is described as being located above the top of the receptacle cover, isolating much of the present apparatus from the receptacle contents.

U.S. Pat. No. 4,276,992 issued on Jul. 7, 1981 to Roland J. Susich discloses a drinking cup with a laterally actuated valve. The valve is normally biased against the bottom surface of the cap by a flexible arm. When the actuator, a trigger that engages a rod, is pressed, a camming surface carried by the rod engages a portion of the valve, forcing it downwards against the impetus of the flexible arm. The rod itself has a biasing arm attached to keep the valve in a normally closed position. As in the patents described hereinabove, most of the elements in the Susich patent are disposed below the surface of the cover, thus exposing them to the contents of the receptacle with the concomitant disadvantages outlined previously and clearly differentiating the Susich patent from the instant invention.

Lastly, U.S. Pat. No. 4,303,173 issued on Dec. 1, 1981, also to Orv B. Nergard discloses a mug type drinking receptacle with cover and valve wherein a trigger and rod actuating system, with the rod carrying a camming surface distal the trigger, engages a valve, normally biased against the lower portion of the cover top, and forcing it downwards and away therefrom. The trigger is disposed 90° away from the dispensing aperture. Again, this does not teach the instant invention as described herein, in that all of the linkage elements of Nergard '173 are in potential contact with the contents of the receptacle, by virtue of being located in the interior thereof.

None of the above inventions and patents, taken either singly or in combination, is seen to describe the instant invention as claimed.

SUMMARY OF THE INVENTION

The present invention is an improved receptacle cover incorporating an actuating trigger connected to a pair of biased valves that seal off the dispensing conduit and the relief vent from the top side of the cover. This construction isolates most of the linkage between the valves and the actuator from the contents of the receptacle. The actuator is a trigger located proximate the upper portion of a handle extending from the cover, and is linked to the valves by a wire that extends to, and moves, a rotating rod that is perpendicularly disposed in relation to the wire. The rod, in turn, is attached to the valves by additional wires that force them open against their proximate leaf springs. The dispensing conduit forms a plenum or chamber that functions in a manner similar to a straw by extending upwards from the cover. This construction prevents inadvertent leakage or fluid build up on the exterior of the receptacle. Alternatively, instead of the leaf springs, the bodies of the valve could be made of a resilient material, and the valves placed in a substantially parallel overlying relationship to the cover top, the construction serving as a bias towards the closing of the dispensing conduit and the relief vent.

Accordingly, it is a principal object of the invention to provide a receptacle cover incorporating valve controlled openings that overcomes the disadvantages of the prior art in a simple but effective manner.

It is another object of the invention to provide a receptacle cover incorporating valve controlled openings wherein the linkage elements are substantially isolated from the contents of the receptacle.

It is yet another object of the invention to provide a receptacle cover incorporating valve controlled openings that has a plenum or chamber over the fluid dispensing conduit, the dispensing chamber extending upwards to prevent accidental spillage when the interior of the receptacle is in fluid communication with the exterior.

It is a further object of the invention to provide a receptacle cover incorporating valve controlled openings where the dispensing chamber also serves to prevent fluid buildup on the exterior of the receptacle by channelling undrunk liquid quickly back into the receptacle interior.

Still another object of the invention is to provide a receptacle cover incorporating valve controlled openings wherein the construction of the cover allows it to be easily cleaned.

It is a major goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
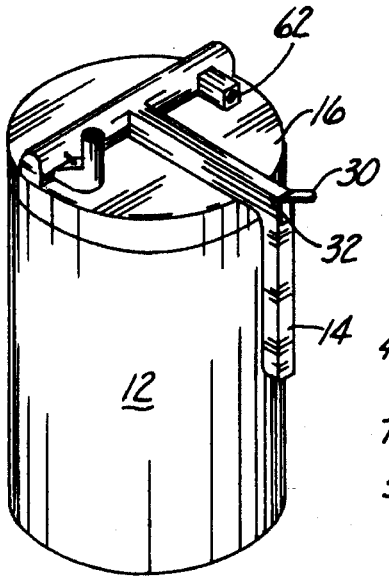
FIG. 1 is a perspective view of the present invention.
Figure 2:
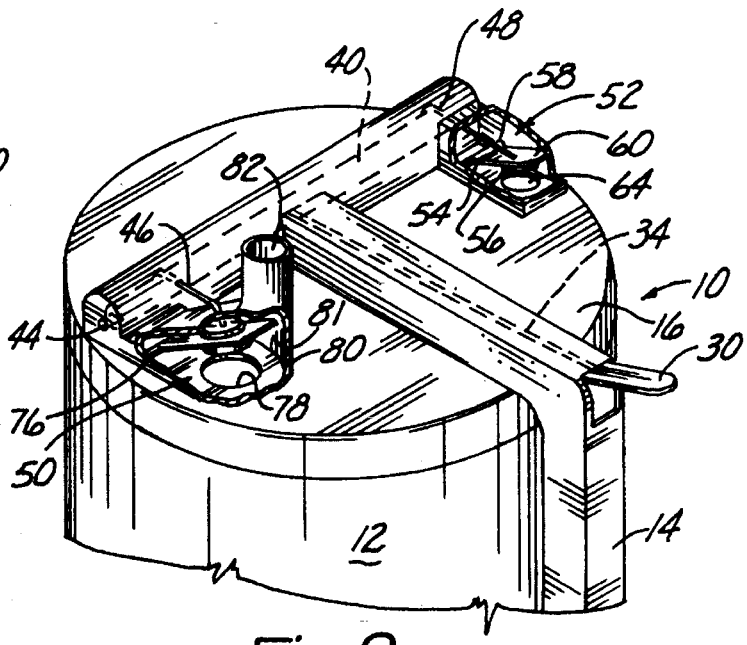
FIG. 2 is a partial perspective view with the actuating wire between the trigger and the rod being shown in dotted lines and the conduit chamber and relief valve chamber being partially cut away to show the interior details thereof.
Figure 3:
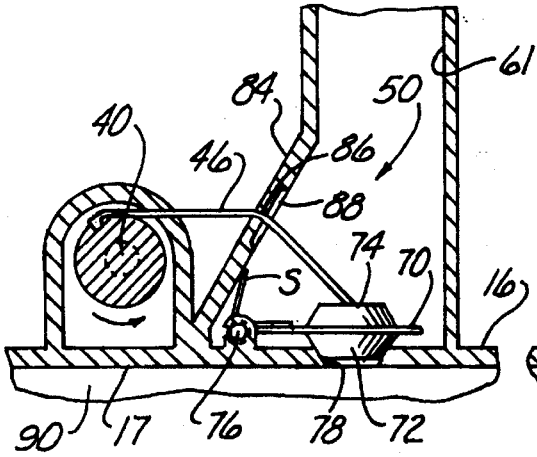
FIG. 3 is an enlarged cutaway view showing the rotating rod, the valve body, the wire extending between the two, and the conduit chamber with the valve in a closed position.
Figure 4:
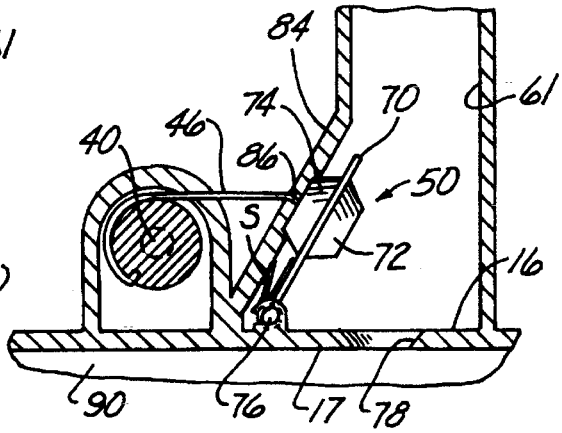
FIG. 4 is an enlarged cutaway view showing the rotating rod, the valve body, the wire extending between the two, and the conduit chamber with the valve in an open position.
Figure 5:
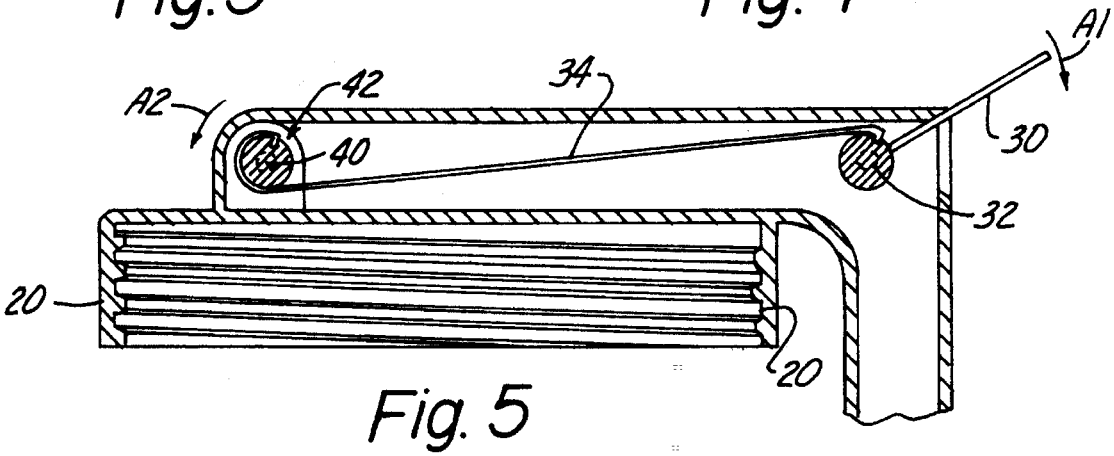
FIG. 5 is an enlarged cutaway view showing the relationship of the trigger, the actuating rod, and the wire extending between them.

The present invention is a cover 10 for a receptacle 12. The cover 10 is removably attached to the receptacle 12, in the embodiment described herein, by threaded engagement means 20, shown in FIG. 5. It should be noted that various other engagement means could be used, such as bayonet joints, friction fits, snap fit clamps, or other well known receptacle cover attachment art devices. Whatever the engagement means used, it should provide a leakproof seal. The cover 10 includes a handle 14 that, as can be seen in FIG. 5, is disposed a sufficient distance from the receptacle body 12 that a user can comfortably grip the handle 14. At the end of handle 14, at a point proximate the top 16 of the cover 10, there is a trigger 30. This is a protruding flap in the preferred embodiment, but emphasis is made that other actuating means could be utilized: for example a sliding bar, a push button, or other means could be used without departing from the spirit of the invention. The trigger 30 is mounted on a hinge 32, shown in FIGS. 1 and 5, is freely rotatable thereabout, and is connected to a wire 34 through the hinge 32 and thus forms the first part of the linkage to the valves, discussed below. The wire 34 (shown in FIGS. 2 and 5) should be of sufficient diameter and flexibility to preclude its inadvertent breakage, is attached to the rotating portion of the hinge 32 at its one end, and to a rotating rod 40 at the other of its ends. The rod 40 is mounted perpendicular to the wire 34, which is wrapped under rod 40 (as seen in FIG. 5) and attached thereto as indicated at 42 in FIG. 5. Rod 40 is mounted such that it is free to rotate about its central longitudinal axis by means of protruding pins 44, one of which is seen in FIG. 2. This type of mounting is well known, and need not be elucidated in detail. Referring to FIG. 2, a pair of valve linkage wires 46, 48 are connected to rod 40 proximate either of its ends. These linkage wires are similar to wire 34, in that they should be made of a sufficiently flexible material and be of a suitable diameter to prevent breakage. They are also attached to rod 40 in a like manner as wire 34, previously indicated at 42. The linkage wires 46, 48 are attached to the valves 50, 52, respectively, at their other ends. These valves 50, 52 will be discussed separately, with the relief valve 52 being addressed first. Referring to FIG. 2, relief valve 52, in this preferred embodiment, is housed within the relief valve chamber 60. This chamber 60 extends upwardly from the top 16 of the cover 10 and is provided with an inflow hole or aperture 62, shown in FIG. 1. Within the relief valve chamber 60 is disposed relief valve 52. In the embodiment described herein, relief valve 52 consists of a relief valve body 54, and a sealing gasket 56. The relief valve body 54 is attached to linkage wire 48 and rotates about a hinge 58 attached to the top 16 of the cover 10. It is contemplated that the hinge 58 could be replaced by a fixed mounting and the relief valve body 54 could be made of a flexible material to allow the sealing gasket 56 carried thereon to be manipulated to variously close and open receptacle inflow aperture 64 when the linkage wire 48 is operated by the user, as will be described more fully hereinafter. Turning now to FIGS. 2, 3, and 4, the outlet control valve 50 will be discussed. Outlet control valve has an outlet control valve body 70, a dispensing aperture gasket 72, an outlet chamber gasket 74, and is connected to a hinge 76. As in the case of the relief valve 52 above, the hinge 76 could be replaced by a fixed mounting and the outlet control valve body 70 could be made of a flexible material to allow the seating and unseating of the gaskets 72, 74 as will be now described.

Normally, the valves 50, 52 are held against the dispensing aperture 78 (seen in FIGS. 2, 3, and 4) and receptacle inflow aperture 64 by leaf springs S (shown in FIGS. 3 and 4) mounted between the valve bodies 54, 70 and the inner walls 61, 81 of the relief valve chamber 60 and the dispensing outlet chamber 80, respectively (discussed in more detail below). In the preferred embodiment the valves 50, 52 are rotatable on hinges 58, 76. As previously discussed, however, if the hinges 58, 76 were instead fixed mountings and the valve bodies 54, 70 were made of flexible material initially disposed in a substantially parallel overlying relationship with the cover top 16, the valve bodies 54, 70 would themselves serve as biasing means to keep apertures 78, 64 sealed off. Turning to FIG. 5, if the user wishes to drink from or otherwise dispense the material contained in the receptacle, trigger 30 is actuated in the direction indicated by arrow A1. This moves wire 34 and the attached rod 40 is rotated in the counterclockwise direction shown by arrow A2. This, in turn, draws the valves 50, 52 into an open position, as seen in FIG. 2, allowing the user to drink from the receptacle or dispense the contents thereof through the dispensing outlet chamber 80. The fluid communication existing between the exterior of the receptacle 12 and the interior thereof via inflow hole 62 and receptacle inflow aperture 64 allows for the smooth flow of the material being dispensed. When trigger 30 is released, the valve biasing means, either the leaf springs S, or flexible fixed valve bodies, returns the sealing gaskets 56, 72 to close their respective apertures, as is seen in FIG. 3. It should be noted that if leaf springs S are used to bias the valves 50, 52, either one or both the valves could have a spring S associated with it. For example, if the number of parts exposed to the flow of the dispensed material is desired to be kept to a minimum, then only valve 52 would have a spring S mounted with it in relief valve chamber 60. The bias of the spring S disposed in that manner would be sufficient to close valve 50 when trigger 30 was released by the user.

The discussion now turns to the novel construction of the dispensing chamber 80. As can be seen in FIG. 2, the chamber 80 extends upwardly from the cover top 16 and terminates in an outlet 82. In the embodiment described herein, the outlet 82 takes a form similar to a drinking straw, though other dimensions and configurations would present themselves as obvious to any practitioner skilled in the receptacle art. The chamber 80 has a back wall 84 proximate to the rod 40 which has a linkage wire aperture 86 therethrough. This aperture 86 is dimensioned to allow the linkage wire 46 to pass easily through it. When valve 50 is in the open position, therefore, outlet chamber gasket 74 seals off linkage wire aperture 86. To enhance the seal, a gasket receiving depression 88 is located on the inner wall 81 of the back wall 84 portion of chamber 80. Thus, through the construction described above, liquid being drunk from the receptacle 12 covered by the present invention will not pool on the exterior of the container, seeing that it would immediately pour back into the interior 90 of the receptacle 12 through dispensing aperture 78. It can be seen then, that none of the parts of the cover 10 extend into the interior 90 of the receptacle 12, the bottom 17 of cover 10 (seen in FIGS. 2 and 3) being the lowest depending portion of the device coming into contact with the contents of the receptacle.

It should also be noted that though upwardly protruding housings are shown to cover both the wire 34 extending between the trigger 30 and the rod 40, and the rod 40 itself, a separate overlying cover (not shown) could be brought to an equal height therewith to present a smooth surface excepting the outlet 82, which needs to extend a sufficient distance thereabove to allow a user to drink from the container.

Figure 6:
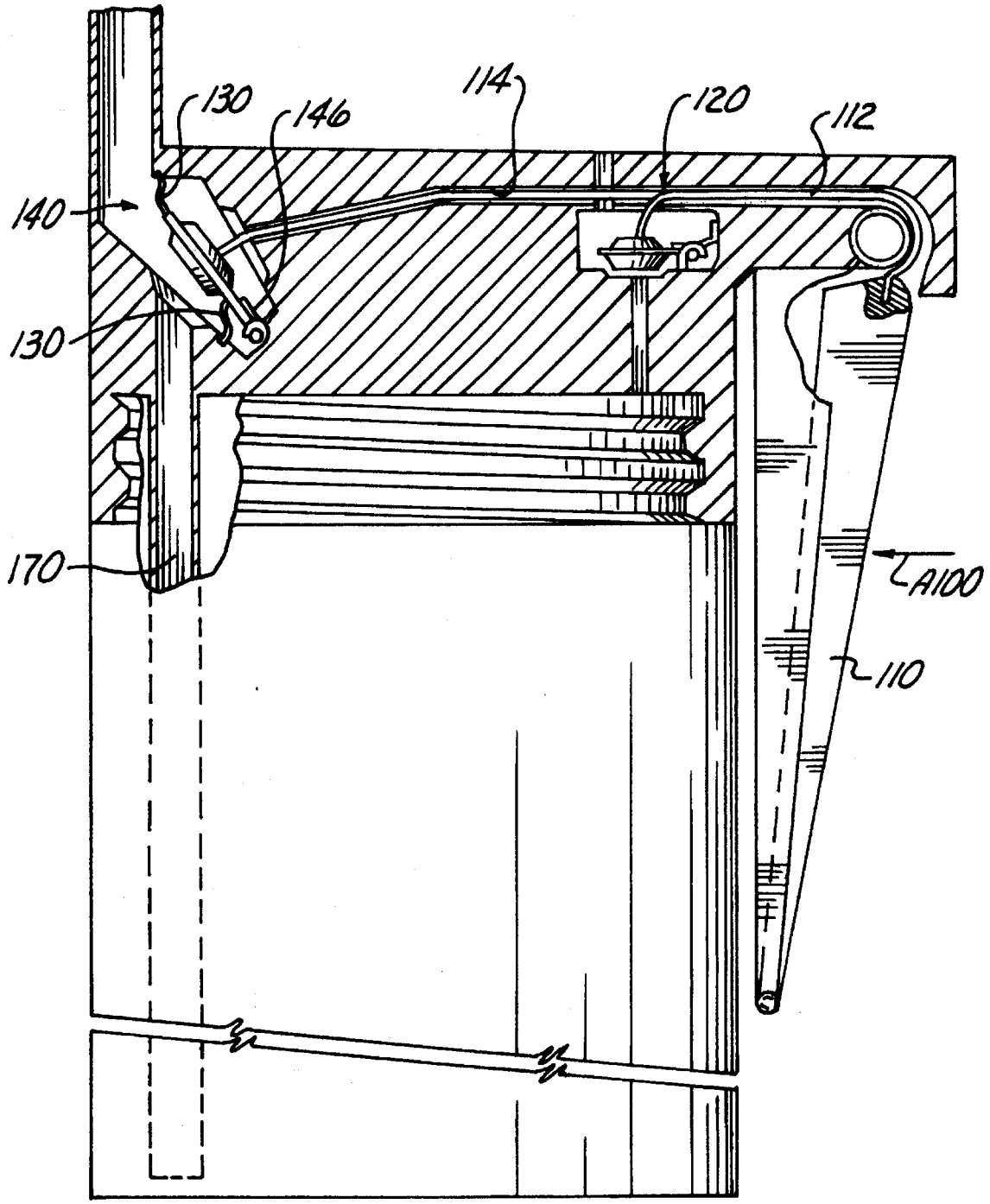
FIG. 6 is a partial cutaway view of an alternative embodiment of the invention, wherein the activation handle is generally parallel with the sides of the receptacle and where the actuation of the valves is activated by squeezing the handle with the fingers.

Referring now to FIG. 6, an alternative embodiment of the invention is shown. The handle 110 lies generally parallel to the body of the receptacle and is activated by the user through squeezing, as indicated by the directional arrow A100. In this embodiment of the invention, only a single "Y" of wire 112 is used, the split of the "Y" being indicated at 120. This wire 112 is carried within an aperture 114. Another feature of this alternative embodiment is the flexible membrane 130 that extends about the valve 140 disposed above the dispensing aperture 144. This membrane 130 seeks to prevent the biasing mechanism or spring 146 from being contaminated by the liquid in the container. Thus, if the liquid contained a large amount of sugar, the membrane 130 would prevent the spring 146 from sticking.

Though no specific materials are discussed for the manufacture of the present invention, skilled practitioners of the receptacle art would find many substances that would serve. Plastic polymer materials, various grades of wire for the linkages, and conventional gasket materials are all old, and various sundry combinations thereof would serve, with the restrictions of manufacturing cost and reliability being the leading concerns in the choices to be made. The types of receptacles that the instant invention would be used with are myriad and span insulated and uninsulated varieties. Additionally, the cover 10 itself may be provided with insulated material incorporated into its structure to prevent heat transfer.

Another optional feature that could be added to the present invention would be to extend a tube from the bottom 17 of the cover 10 as an extension of the dispensing aperture 78 such that when the cover 10 is in engagement with the receptacle 12, the dispensing aperture extension functions like a straw, so that the user does not need to tilt the receptacle 12 to drink therefrom. This feature is shown in the alternative embodiment of FIG. 6 and is indicated at 170.

It is to be understood that the present invention is not limited to the sole embodiment described above, but encompasses any and all embodiments within the scope of the following claims.

I claim:

1. A cover for a receptacle, the receptacle having an interior and means to define an opening thereinto, comprising:

detachable securement means, for attaching and detaching said cover over the receptacle opening;

a plate having a top and a bottom, said plate including a first dispensing aperture and a second inflow aperture both said first and second apertures extending completely from said top to said bottom of said plate, said plate being dimensioned such that the receptacle opening is otherwise substantially completely covered when said cover is attached by said detachable securement means;

a dispensing valve member disposed above said top of said plate and dimensioned such that said dispensing aperture is substantially completely covered;

a relief valve member disposed above said top of said plate and dimensioned such that said inflow aperture is substantially completely covered;

a dispensing chamber disposed above said top of said plate, extending upwardly therefrom and over said dispensing aperture, said dispensing chamber dimensioned such that said dispensing valve member is contained therein, and said dispensing chamber including an outlet; and simultaneous actuation means to simultaneously position both said dispensing valve member and said relief valve member such that said dispensing aperture and said inflow aperture are unobstructed, thus allowing fluid communication between said top of said plate and said bottom of said plate; whereby said cover is placed over a receptacle, said simultaneous actuation means positions said dispensing valve member and said relief valve member such that fluid communication exists between said top of said plate and the interior of the receptacle, and the contents of the receptacle are smoothly dispensed through said outlet means in said dispensing chamber, the volume of the dispensed contents being replaced through said inflow aperture.

2. The receptacle cover according to claim 1, where said plate includes an outer periphery and said simultaneous actuation means includes:

a handle extending radially outwardly from said periphery;

an actuating member with a manipulable end located on said handle and extending inwardly above said top of said plate, said actuating member end distal of said manipulable member being attached to a rod, said rod having two ends, said rod being disposed perpendicular to said actuating member, said rod being located above said top of said plate and being suspended within a rod housing on pins extending from said rod ends such that said rod is freely rotatable about its central longitudinal axis when said actuating member is moved towards and away from said rod;

valve linkage means extending from said rod to said dispensing valve member and said relief valve member, said valve linkage means being located proximate said rod ends, said valve linkage means disposed such that as said rod rotates, said dispensing valve member and said relief valve member are simultaneously moved from closed to open configurations, enabling or disabling fluid communication between the interior of the receptacle and said top of said plate.

3. The receptacle cover according to claim 2, including a biasing means to bias said dispensing valve member and said relief valve member to a position where said dispensing aperture and said inflow aperture are closed, such that only upon manipulation of said actuation means and, thus, said rod and said valve linkage means does fluid communication exist between said top of said plate and the interior of the receptacle.

4. The receptacle cover according to claim 2, wherein said dispensing chamber includes a linkage aperture therein for the passage of said valve linkage means, and where said dispensing valve member includes a valve body, a dispensing aperture gasket, and a outlet chamber gasket, said outlet chamber gasket being located such that when said dispensing valve member is in an open configuration, said outlet chamber gasket substantially completely closes said linkage aperture.

5. The receptacle cover according to claim 4, including a biasing means to bias said dispensing valve member and said relief valve member to a position where said dispensing aperture and said inflow aperture are closed, such that only upon manipulation of said actuation means and, thus, said rod and said valve linkage means does fluid communication exist between said top of said plate and the interior of the receptacle.

6. The receptacle cover according to claim 2 wherein said detachable securement means is a threaded engagement.

7. The receptacle cover according to claim 6, wherein said dispensing chamber includes a linkage aperture therein for the passage of said valve linkage means, and where said dispensing valve includes an outlet chamber gasket, said outlet chamber gasket being located such that when said dispensing valve is in an open configuration, said outlet chamber gasket substantially completely closes said linkage aperture.

8. The receptacle cover according to claim 2, wherein said dispensing valve member and said relief valve member both include a resilient valve body member, said dispensing valve member includes a dispensing aperture gasket, and said relief valve member includes an sealing gasket, and where both of said resilient valve body members are attached to said top of said plate in a substantially parallel overlying position therewith, such that said valve members are biased to a position where both said dispensing aperture and said inflow aperture are substantially entirely closed.

9. The receptacle cover according to claim 8 wherein said detachable securement means is a threaded engagement.

* * * * *